US011604429B2

(12) United States Patent
Kamizato

(10) Patent No.: US 11,604,429 B2
(45) Date of Patent: Mar. 14, 2023

(54) SHEET CONVEYANCE APPARATUS AND IMAGE FORMING APPARATUS

(71) Applicant: CANON KABUSHIKI KAISHA, Tokyo (JP)

(72) Inventor: Shoji Kamizato, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 837 days.

(21) Appl. No.: 16/442,957

(22) Filed: Jun. 17, 2019

(65) Prior Publication Data

US 2020/0012225 A1 Jan. 9, 2020

(30) Foreign Application Priority Data

Jul. 5, 2018 (JP) ..... JP2018-128623

(51) Int. Cl.
*B65H 5/06* (2006.01)
*G03G 15/00* (2006.01)

(52) U.S. Cl.
CPC ..... *G03G 15/6529* (2013.01); *B65H 5/062* (2013.01); *B65H 2301/5115* (2013.01); *B65H 2404/144* (2013.01)

(58) Field of Classification Search
CPC ..... B65H 5/062; B65H 2404/144; B65H 2301/5115
See application file for complete search history.

(56) References Cited

U.S. PATENT DOCUMENTS

| | | | | |
|---|---|---|---|---|
| 5,740,498 | A * | 4/1998 | Tsuchiya | G03G 15/6558 399/98 |
| 8,452,224 | B2 | 5/2013 | Ishioka | |
| 9,487,367 | B2 * | 11/2016 | Otsuki | B65H 9/006 |
| 10,029,489 | B2 * | 7/2018 | Nakahata | B65H 85/00 |
| 10,983,471 | B2 * | 4/2021 | Noguchi | B65H 5/062 |

(Continued)

FOREIGN PATENT DOCUMENTS

| | | |
|---|---|---|
| JP | H09-240870 A | 9/1997 |
| JP | 2002-255398 A | 9/2002 |

(Continued)

OTHER PUBLICATIONS

Japanese Office Action dated Apr. 19, 2022, in related Japanese Patent Application No. 2018-128623.

*Primary Examiner* — Patrick Cicchino
(74) *Attorney, Agent, or Firm* — Venable LLP

(57) ABSTRACT

A sheet conveyance apparatus includes a rotary member and an opposing member to convey a sheet in a conveyance nip, and an abutting member abutting a surface of the rotary member, which is supported between a first position and a second position with respect to the abutting member. When the sheet is not passing through the conveyance nip the rotary member is positioned at the first position and abuts the opposing member, and when the sheet is passing through the conveyance nip the rotary member is positioned at the second position which is more separated from the opposing member than the first position. The abutting member abuts the rotary member regardless of which of the first position and the second position the rotary member is positioned at, and the opposing member and the abutting member are supported so they do not move in a radial direction of the rotary member.

17 Claims, 9 Drawing Sheets

(56) References Cited

U.S. PATENT DOCUMENTS

| | | | | |
|---|---|---|---|---|
| 11,048,202 | B2 * | 6/2021 | Hayashi | G03G 15/6573 |
| 2003/0049043 | A1 * | 3/2003 | Fuwazaki | B41J 13/02 399/98 |
| 2011/0150553 | A1 * | 6/2011 | Akatsuka | G03G 15/6511 271/10.09 |

FOREIGN PATENT DOCUMENTS

| | | | |
|---|---|---|---|
| JP | 2008-056434 | A | 3/2008 |
| JP | 2010-037008 | A | 2/2010 |
| JP | 2010-241530 | A | 10/2010 |
| JP | 2011-126662 | A | 6/2011 |
| JP | 2014-046996 | A | 3/2014 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus configured to convey a sheet and an image forming apparatus including the sheet conveyance apparatus.

Description of the Related Art

Generally, a printer of an electrophotographic system transfers a toner image formed on a photosensitive drum onto a sheet fed from a cassette, and discharges the sheet to the outside of the printer after fixing the toner image to the sheet. Sometimes paper dust is generated on the sheet as a result of being rubbed by a conveyance roller, a separation pad, or the like, and image quality is degraded when the paper dust attaches to the photosensitive drum or the toner.

Conventionally, a printer including a registration roller and a paper dust removing portion disposed to oppose the registration roller is proposed in Japanese Patent Laid-Open No. 2014-046996. The paper dust removing portion includes a paper dust removing roller and a pressing member. The paper dust removing roller nips a sheet with the registration roller to collect paper dust from the sheet, and the pressing member comes into contact with the paper dust removing roller to scrape off the paper dust attached to the paper dust removing roller. The pressing member is in pressure contact with the paper dust removing roller by an urging force of a spring.

The paper dust removing portion described in Japanese Patent Laid-Open No. 2014-046996 swings toward a separated position when a sheet gets in between the registration roller and the paper dust removing roller. At this time, the paper dust removing roller and the pressing member of the paper dust removing portion integrally swing, and therefore the relative positions of the paper dust removing roller and the pressing roller do not change. Therefore, the pressing member formed from a sponge or the like is in pressure contact with the paper dust removing roller always at the same position, and creep deformation is caused by stress applied to the pressing member in the case where, for example, the paper dust removing portion is stored or used for a long period. In the case where the pressing member is deformed, the performance of the pressing member scraping off the paper dust is degraded. Further, there is a risk that paper dust not sufficiently removed from the paper dust removing roller attaches to the photosensitive drum or the toner, thereby causing image defects.

SUMMARY OF THE INVENTION

According to one aspect of the present invention, a sheet conveyance apparatus includes a conveyance portion including a rotary member and an opposing member and configured to convey a sheet in a conveyance nip, the opposing member being configured to oppose the rotary member to form the conveyance nip together with the rotary member, an abutting member configured to abut a surface of the rotary member, and a support portion configured to rotatably support the rotary member, wherein the support portion supports the rotary member such that the rotary member is relatively movable between a first position and a second position with respect to the abutting member, wherein when the sheet is not passing through the conveyance nip, the rotary member is positioned at the first position where the rotary member abuts the opposing member, and when the sheet is passing through the conveyance nip, the rotary member is positioned at the second position which is more separated from the opposing member than the first position by a thickness of the sheet passing through the conveyance nip, and wherein the abutting member abuts the rotary member regardless of which of the first position and the second position the rotary member is positioned at.

Further features of the present invention will become apparent from the following description of exemplary embodiments with reference to the attached drawings.

BRIEF DESCRIPTION OF THE DRAWINGS

FIG. 6A is a section view of a paper dust attracting roller and a sponge before long-term storage when no sheet is being passed through.

FIG. 6B is a section view of the paper dust attracting roller and the sponge after long-term storage when no sheet is being passed through.

FIG. 6C is a section view of the paper dust attracting roller and the sponge after long-term storage when a sheet is being passed through.

DESCRIPTION OF THE EMBODIMENTS

First Exemplary Embodiment

Overall Configuration

First, a first exemplary embodiment of the present invention will be described. A printer 100 serving as an image forming apparatus is a laser beam printer of an electrophotographic system that forms a monochromatic toner image. To be noted, in the following description, a sheet P is a medium on which an image is formed by the printer 100, and examples thereof include paper sheets and sheets of overhead transparencies.

Figure 1:
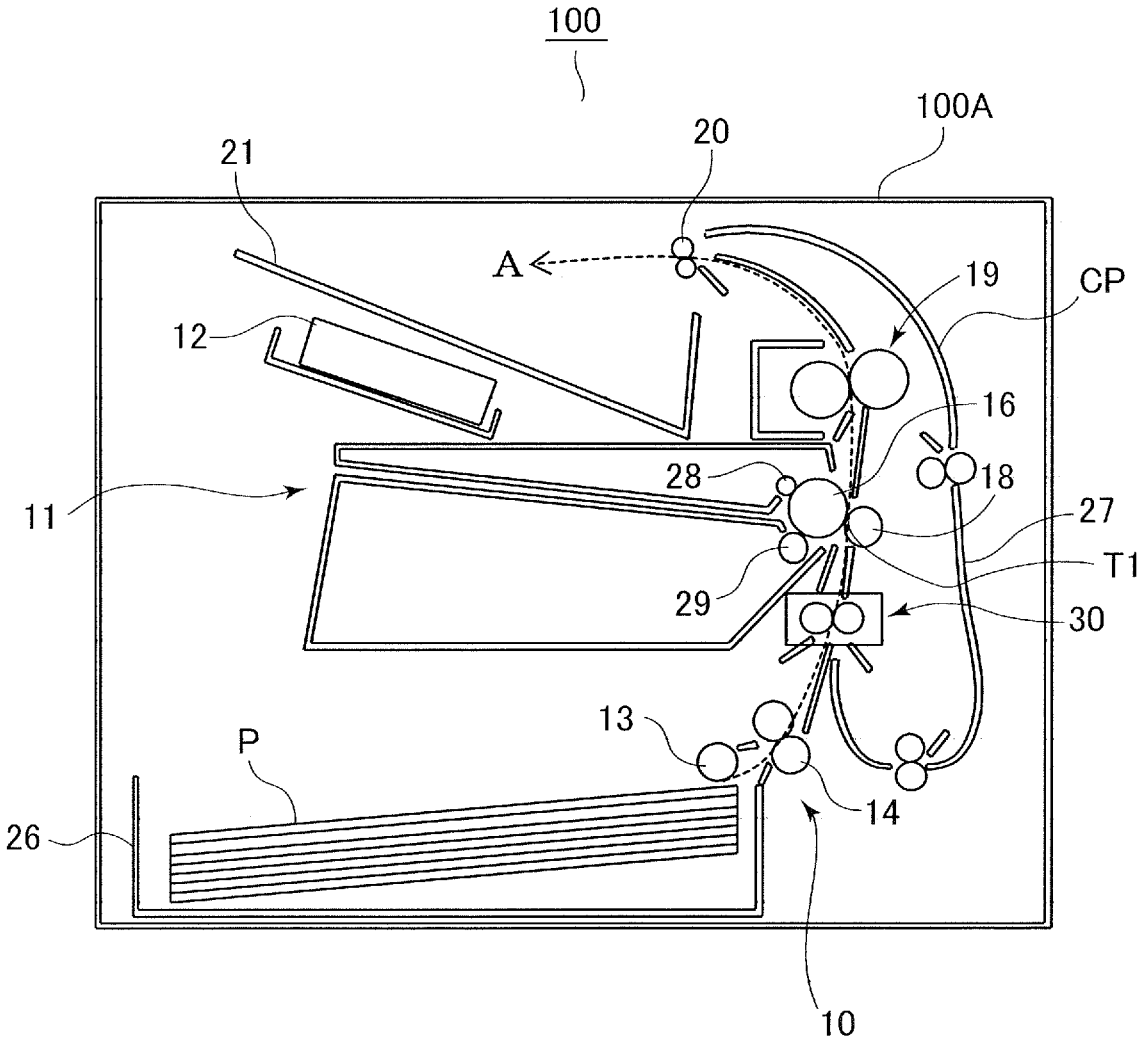
FIG. 1 is an overall schematic view of a printer according to a first exemplary embodiment.

As illustrated in FIG. 1, the printer 100 includes a sheet feeding unit 10 that feeds a sheet from a stack of sheets, and a sheet conveyance apparatus 30 that conveys the sheet fed by the sheet feeding unit 10. In addition, the printer 100 includes an image forming portion 11, a fixing unit 19, and a discharge roller pair 20. The image forming portion 11 forms an image on the sheet conveyed by the sheet conveyance apparatus 30, the fixing unit 19 fixes the image transferred onto the sheet, and the discharge roller pair 20 is configured to discharge the sheet onto a discharge tray 21.

When an image formation job is output to the printer 100, an image formation process by the image forming portion 11 is started on the basis of image information input from an external computer or the like connected to the printer 100. The image forming portion 11 includes a laser scanner 12, a photosensitive drum 16, a charging roller 28, a developing roller 29, and a transfer roller 18. The photosensitive drum 16, the charging roller 28, and the developing roller 29 are provided as one cartridge such that these can be collectively replaced. The photosensitive drum 16 and the transfer roller 18 form a transfer nip T1.

The laser scanner 12 radiates laser light toward the photosensitive drum 16 on the basis of the input image information. At this time, the photosensitive drum 16 has been charged by the charging roller 28 in advance, and an electrostatic latent image is formed on the photosensitive drum 16 as a result of the irradiation of the laser light. Then, this electrostatic latent image is developed by the developing roller 29, and thus a monochromatic toner image is formed on the photosensitive drum 16.

In parallel with the image formation process described above, a sheet P is fed from the sheet feeding unit 10. The sheet feeding unit 10 includes a cassette 26, a feeding roller 13, and a separation roller pair 14. The cassette 26 can be drawn out from and attached to an apparatus body 100A of the printer 100. The sheet P accommodated in the cassette 26 is fed by the feeding roller 13, and when a plurality of sheets P are fed by the feeding roller 13, one sheet P is separated from another sheet by the separation roller pair 14. When the feeding roller 13 and the separation roller pair 14 rub the sheet, paper dust is sometimes generated on the surface of the sheet P. The paper dust generated on the surface of the sheet P is collected by a sheet conveyance apparatus 30 that will be described later.

To be noted, the cassette 26 may include an inner plate capable of supporting sheets thereon and capable of ascending and descending. For example, when an image formation job is input, the inner plate may be caused to ascend and thus a sheet supported on the inner plate may be brought into contact with the feeding roller 13. In addition, one of the separation roller pair 14 may be a pad or the like, and a torque limiter system, a retard roller system, and the like can be applied thereto.

A toner image on the photosensitive drum 16 is transferred onto the sheet P conveyed by the sheet conveyance apparatus 30 at the transfer nip T1 by an electrostatic load bias applied to the transfer roller 18. Residual toner remaining on the photosensitive drum 16 is collected by an unillustrated cleaning blade. The sheet P onto which the toner image has been transferred is subjected to predetermined heat and pressure from the fixing unit 19, and thus the toner is melted and adhered, that is, fixed. The sheet P having passed through the fixing unit 19 is discharged onto the discharge tray 21 by the discharge roller pair 20. A conveyance path A indicated by a broken line in FIG. 1 is a virtual conveyance path of the sheet P.

To be noted, a registration roller pair capable of correcting the skew of the sheet P may be provided between the sheet conveyance apparatus 30 and the transfer nip T1. The skew of the sheet P is corrected by abutting the nip of the registration roller pair in a stationary state. The registration roller pair conveys the sheet P at a timing matching the transfer timing of the toner image at the transfer nip T1.

In the case of forming images on both surfaces of the sheet P, the sheet P on a first surface of which an image has been formed is switched back by the discharge roller pair 20, and is conveyed to a duplex conveyance path CP. The duplex conveyance path CP guides the sheet P to the sheet conveyance apparatus 30 again. Then, an image is formed on a second surface of the sheet P at the transfer nip T1, and the sheet P is discharged onto the discharge tray 21.

Sheet Conveyance Apparatus

Figure 2:
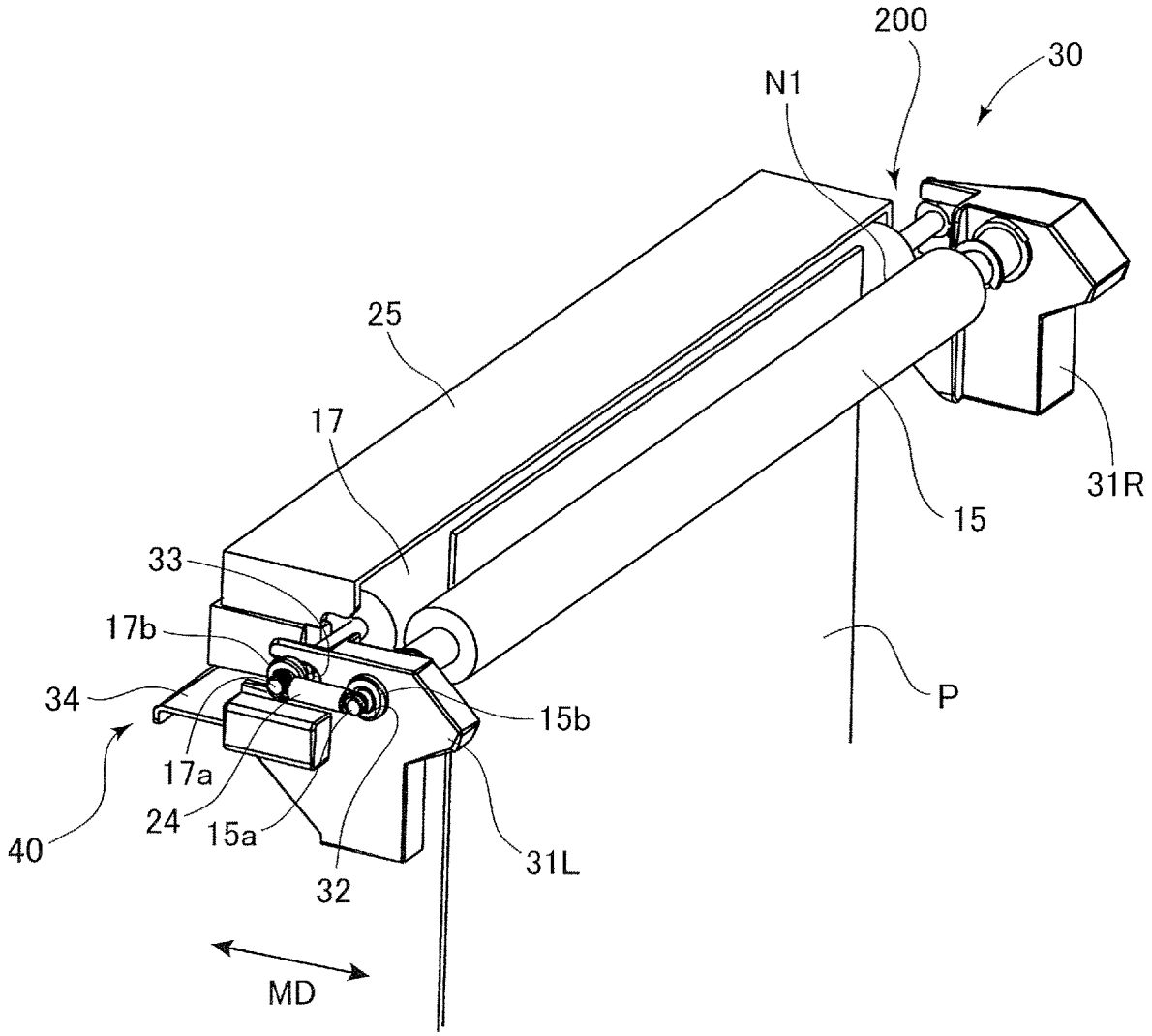
FIG. 2 is a perspective view of a sheet conveyance apparatus.
Figure 3A:
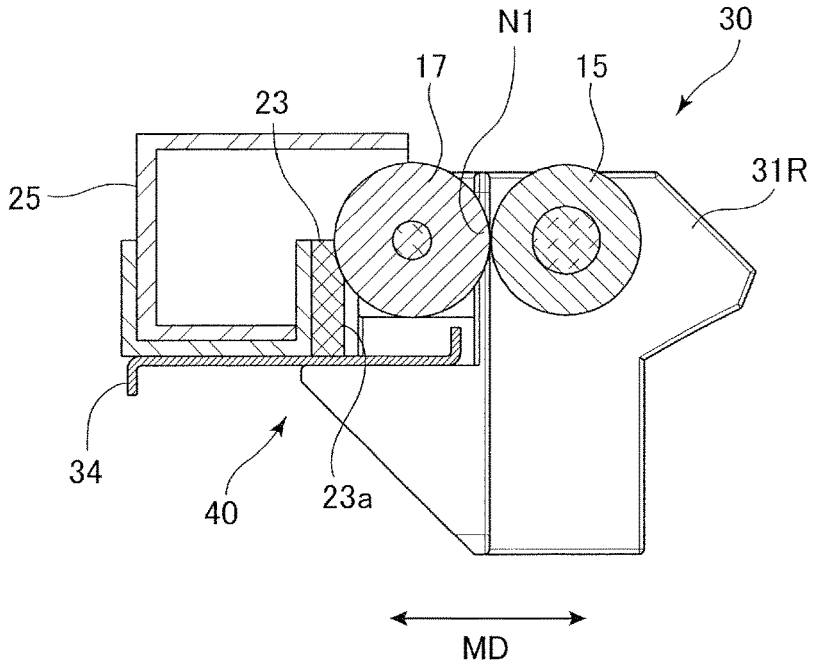
FIG. 3A is a section view of the sheet conveyance apparatus when a sheet is not passing through a conveyance nip.
Figure 3B:
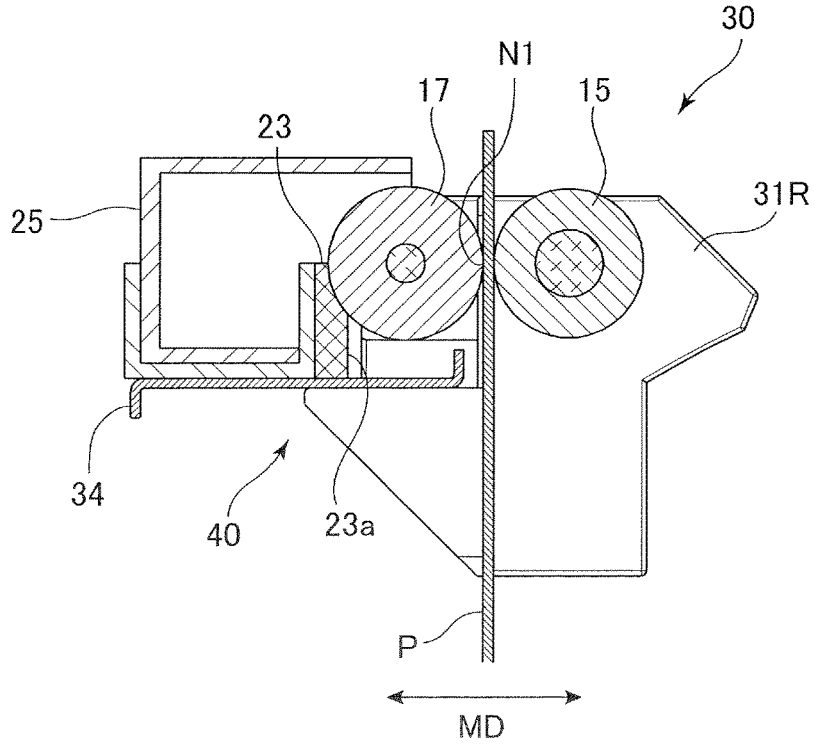
FIG. 3B is a section view of the sheet conveyance apparatus when a sheet is passing through the conveyance nip.

Next, the sheet conveyance apparatus 30 will be described in detail with reference to FIGS. 2 to 4B. As illustrated in FIGS. 2, 3A, and 3B, the sheet conveyance apparatus 30 includes a frame portion 40, a driving roller 15, a paper dust attracting roller 17, and a pulling spring 24. The frame portion 40 is fixed to the apparatus body 100A, the driving roller 15 is driven by an unillustrated motor, and the paper dust attracting roller 17 abuts the driving roller 15 and is thus rotationally driven in accordance with the driving roller 15. The driving roller 15 serving as an opposing member opposes the paper dust attracting roller 17 serving as a rotary member, and forms a conveyance nip N1 together with the paper dust attracting roller 17. The driving roller 15 and the paper dust attracting roller 17 constitute a conveyance portion 200 that conveys a sheet in the conveyance nip N1.

The frame portion 40 serving as a support portion includes a left frame 31L, a right frame 31R, a plate member 34, and a paper dust accommodating container 25. The left frame 31L and the right frame 31R are arranged parallel in the width direction of the sheet. The plate member 34 is formed from, for example, a metal plate. The paper dust accommodating container 25 is fixed to the plate member 34. As illustrated in FIGS. 3A and 3B, a sponge 23 serving as an abutting member is fixed to the paper dust accommodating container 25 and the plate member 34. The sponge 23 abuts the surface of the paper dust attracting roller 17 to scrape off paper dust attached to the surface of the paper dust attracting roller 17.

The left frame 31L and the right frame 31R have the same configuration. Therefore, only the left frame 31L will be described below, and description of the right frame 31R will be omitted. The left frame 31L includes a hole portion 32 and an elongated hole portion 33. The hole portion 32 is capable of rotatably supporting a rotation shaft 15*a* of the driving roller 15 via a bearing 15*b*, and the elongated hole portion 33 is capable of rotatably supporting a rotation shaft 17*a* of the paper dust attracting roller 17 via a bearing 17*b*. The bearing 15*b* is fit in the hole portion 32, and is immobile in the radial direction of the paper dust attracting roller 17. That is, the frame portion 40 supports the driving roller 15 and the sponge 23 such that the driving roller 15 and the sponge 23 do not move in the radial direction of the paper dust attracting roller 17, and rotatably supports the paper dust attracting roller 17 such that the paper dust attracting roller 17 is relatively movable with respect to the sponge 23. To be noted, the elongated hole portion 33 may be a cutout one side of which is open as long as the paper dust attracting roller 17 does not get disengaged from the left frame 31L.

Figure 9:
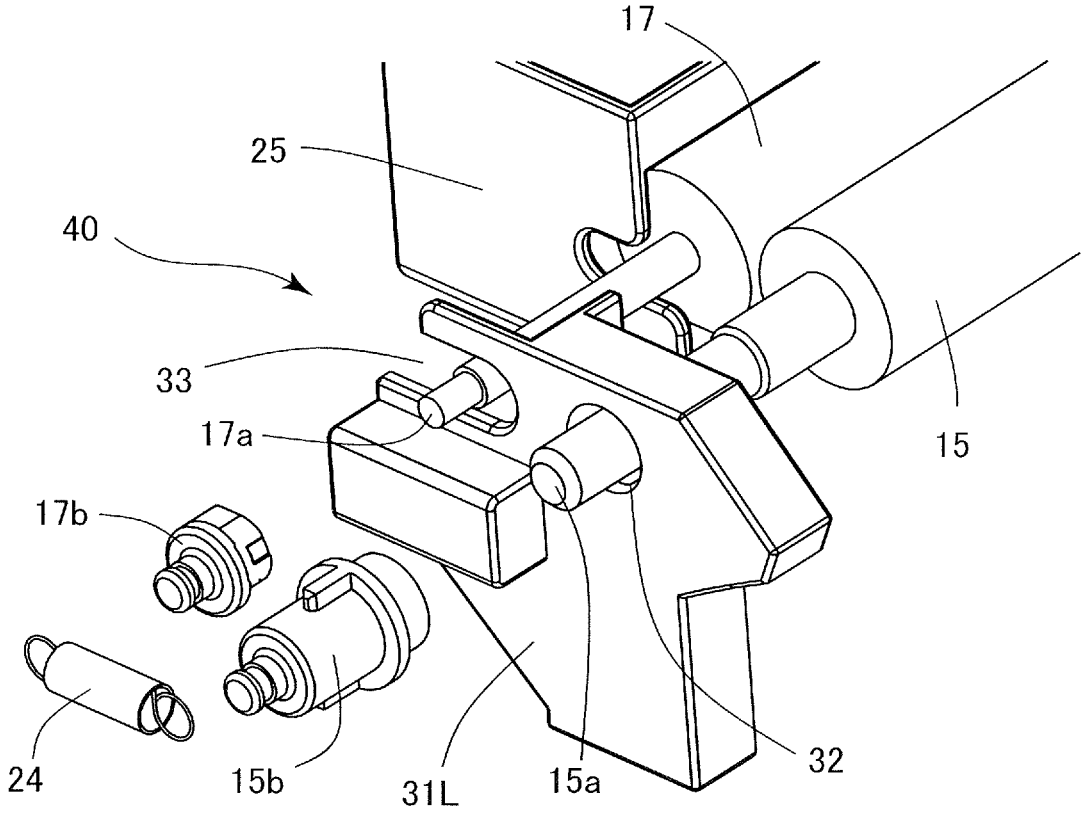
FIG. 9 is a disassembled perspective view for explaining a hole portion and an elongated hole portion.

FIG. 9 is a disassembled perspective view for explaining a hole portion 32 and an elongated hole portion 33. The left frame 31L includes the hole portion 32 and the elongated hole portion 33. The bearing 15*b* of the driving roller 15 is configured to be attached to the hole portion 32 and configured to rotatably support the rotation shaft 15*a*. bearing 17*b* is configured to be attached to the elongated hole portion 33 and configured to rotatably support the rotation shaft 17*a* of the paper dust attracting roller 17. The bearings 15*b* and 17*b* are connected by the pulling spring 24. Since each of the bearings and hole portions are fitted each other, the frame portion 40 immovably supports the driving roller 15 and sponge 23 in the radial direction and relatively movably supports the paper dust attracting roller 17 with respect to the driving roller 15 3 in the radial direction. To be noted, the elongated hole portion 33, as illustrated in FIG. 9, may be a cutout one side of which is open as long as the paper dust attracting roller 17 does not get disengaged from the left frame 31L.

The pulling spring 24 is stretched between the rotation shaft 15*a* of the driving roller 15 and the rotation shaft 17*a* of the paper dust attracting roller 17. The pulling spring 24 serving as an urging member urges the paper dust attracting roller 17 toward the driving roller 15. As illustrated in FIG. 3A, the paper dust attracting roller 17 supported in the elongated hole portion 33 is capable of moving between a first position at which the paper dust attracting roller 17 abuts the driving roller 15 and a second position at which the paper dust attracting roller 17 is separated from the driving roller 15 and which is a different relative position from the first position with respect to the sponge. As described above, the paper dust attracting roller 17 is configured to be movable between the first position and the second position in a movement direction MD. The elongated hole portion 33 is defined such that the longitudinal direction thereof coincides with the movement direction MD.

The sponge 23 includes an opposing surface 23*a* serving as a first opposing surface extending in a direction perpendicular to the movement direction MD and opposing the paper dust attracting roller 17. Further, part of the opposing surface 23*a* of the sponge 23 is always in contact with the surface of the paper dust attracting roller 17. For example, the surface of the paper dust attracting roller 17 is coated with a fluorine resin, and the sponge 23 is constituted by a sponge member formed from nylon, which is an elastic member. To be noted, the extending direction of the opposing surface 23*a* is not limited to the direction perpendicular to the movement direction MD as long as the extending direction intersects the movement direction MD.

When the paper dust attracting roller 17 is rotated in accordance with the driving roller 15, the surface of the paper dust attracting roller 17 is charged by being rubbed by the sponge 23. More specifically, the surface of the paper dust attracting roller 17 coated with a fluorine resin is likely to be negatively charged, and the sponge 23 constituted by a sponge member formed from nylon is likely to be positively charged.

Therefore, paper dust generated on the feeding roller 13 and the separation roller pair 14, attached to the surface of the sheet P, and positively charged is electrostatically attracted to the paper dust attracting roller 17. The paper dust attached to the surface of the paper dust attracting roller 17 is scraped off by the sponge 23, and stored in the paper dust accommodating container 25. As a result of this, degradation of image quality caused by paper dust attaching to the photosensitive drum 16 and toner can be suppressed. In addition, as a result of the paper dust on the sheet P being scraped off, slip of the sheet P in the transfer nip T1 is suppressed, and thus image defects such as image deviation in the transfer nip T1 can be suppressed. In addition, since the sponge 23 is always in contact with the paper dust attracting roller 17, scatter of paper dust accumulated in the sponge 23 to the conveyance path can be suppressed. Further, since the sponge 23 is also capable of scraping off paper dust having small particle size such as filler contained in the sheet P, image defects caused by the paper dust can be reduced. Examples of the filler include calcium carbonate and talc.

Here, the function of the sponge 23 will be described with regard to the performance of removing paper dust from the sheet P and the performance of collecting paper dust from the paper dust attracting roller 17. Since electrostatic attraction force is used to remove paper dust from the sheet P as described above, the paper dust removing performance depends on the amount of charge of the paper dust attracting roller 17. When the contact pressure between the paper dust attracting roller 17 and the sponge 23 increases, the contact area therebetween increases, and the amount of charge of the surface of the paper dust attracting roller 17 increases. Conversely, when the contact pressure between the paper dust attracting roller 17 and the sponge 23 is reduced, the amount of charge of the surface of the paper dust attracting roller 17 is reduced.

The sponge 23 is in pressure contact with the surface of the paper dust attracting roller 17 to scrape off the paper dust attached to the surface of the paper dust attracting roller 17. Therefore, when the contact pressure between the paper dust attracting roller 17 and the sponge 23 is reduced, paper dust attached to the paper dust attracting roller 17 becomes more likely to slip through the sponge 23. As described above, the contact pressure of the sponge 23 on the paper dust attracting roller 17 affects the performance of removing paper dust from the sheet P and the performance of collecting paper dust from the paper dust attracting roller 17. Therefore, the relative position of the sponge 23 with respect to the paper dust attracting roller 17 is important.

Positional Relationship Between Paper Dust Attracting Roller and Sponge

Figure 4A:
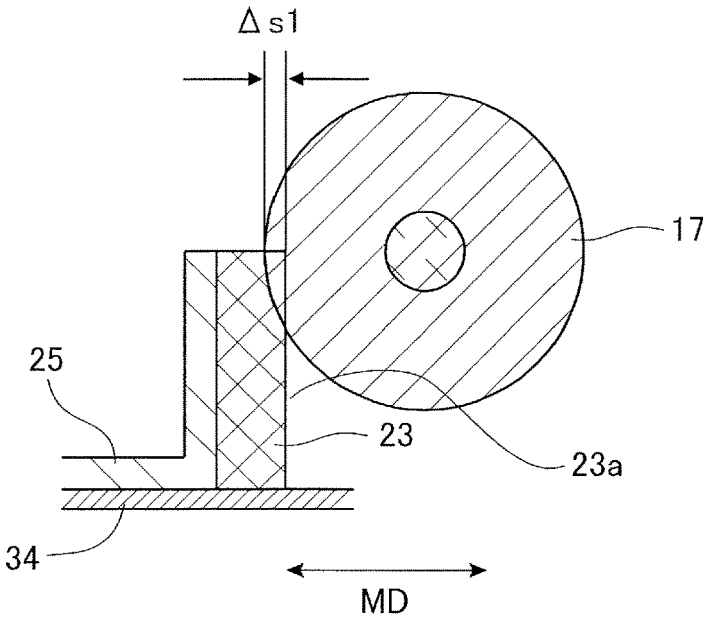
FIG. 4A is a section view of a paper dust attracting roller and a sponge illustrating a relative layout relationship therebetween when a sheet is not passing through the conveyance nip.

Next, the positional relationship between the paper dust attracting roller 17 and the sponge 23 when the sheet P is not passing through the conveyance nip N1 and when the sheet P is passing through the conveyance nip N1 will be described. As illustrated in FIG. 3A, when the sheet P is not passing through the conveyance nip N1, the paper dust attracting roller 17 is positioned at a first position. At this time, as illustrated in FIG. 4A, the paper dust attracting roller 17 sinks in the sponge 23 by a first distance Δs1 from the opposing surface 23*a* in the movement direction MD, and the sponge 23 is in contact with the paper dust attracting roller 17 by a first contact pressure.

Figure 4B:
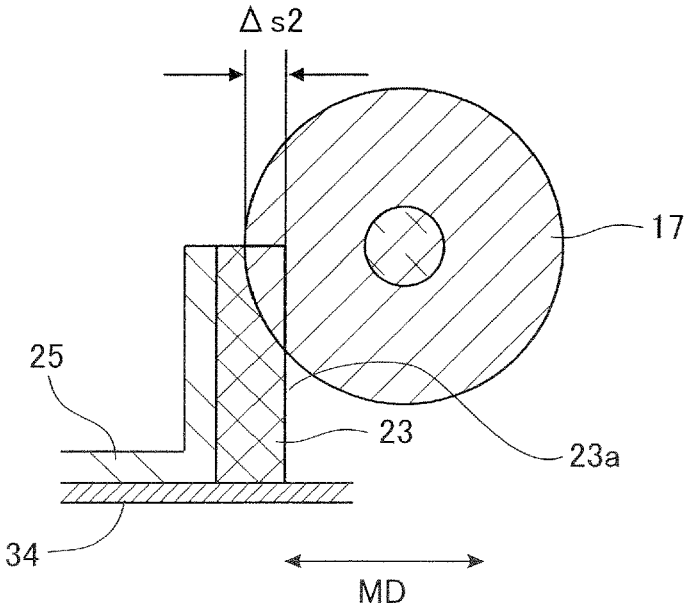
FIG. 4B is a section view of the paper dust attracting roller and the sponge illustrating a relative layout relationship therebetween when a sheet is passing through the conveyance nip.

In addition, as illustrated in FIG. 3B, when the sheet P is passing through the conveyance nip N1, the paper dust attracting roller 17 moves from the first position to a second position against the urging force of the pulling spring 24 illustrated in FIG. 2 due to the thickness of the sheet P passing through the conveyance nip N1. At this time, as illustrated in FIG. 4B, the paper dust attracting roller 17 sinks in the sponge 23 by a second distance Δs2 larger than the first distance Δs1 from the opposing surface 23*a* in the movement direction MD. Therefore, the sponge 23 is in contact with the paper dust attracting roller 17 by a second contact pressure larger than the first contact pressure. To be noted, the sponge 23 is in contact with the paper dust attracting roller 17 regardless of which of the first position and the second position the paper dust attracting roller 17 is positioned at.

As described above, in the present exemplary embodiment, when the sheet P passes through the conveyance nip N1, the paper dust attracting roller 17 moves from the first position to the second position, and the contact pressure between the paper dust attracting roller 17 and the sponge 23 is changed by the movement of the paper dust attracting roller 17. That is, while the sheet P is passing through the conveyance nip N1, the paper dust attracting roller 17 is positioned at the second position, and is in contact with the sponge 23 by the second contact pressure that is relatively large. As a result of this, the amount of charge of the paper dust attracting roller 17 is increased, thus the paper dust removing performance of the paper dust attracting roller 17 is improved, and the paper dust attached to the paper dust attracting roller 17 can be more reliably scraped off by the sponge 23.

In addition, when the sheet P is not passing through the conveyance nip N1, the paper dust attracting roller 17 is positioned at the first position, and is in contact with the sponge 23 by the first contact pressure that is relatively small. To be noted, at this time, since the sponge 23 is not separated from the paper dust attracting roller 17, paper dust accumulated in the sponge 23 does not flow back to the conveyance path. In addition, since the stress applied to the sponge 23 is smaller than while the sheet P is passing through the conveyance nip N1, the creep deformation of the sponge 23 can be reduced particularly during long-term storage or in a user environment in which the non-sheet-passing period is longer than the sheet-passing period, and thus the lifetime of the sponge 23 can be elongated.

When the sponge 23 is deformed, paper dust gets into the deformed portion of the sponge 23 or the contact pressure between the sponge 23 and the paper dust attracting roller 17 is reduced, and thus the paper dust removing performance of the sponge 23 is degraded. However, in the present exemplary embodiment, deformation of the sponge 23 can be suppressed, thus the performance of the sponge 23 can be maintained, and image defects can be suppressed.

In addition, as a result of the paper dust attracting roller 17 relatively moving with respect to the sponge 23, external noise is added to the sponge 23 and the paper dust accumulated in the sponge 23, and thus the paper dust accumulated in the sponge 23 is scattered into the paper dust accommodating container 25. As a result of this, the paper dust accumulated in the sponge 23 is reduced, the paper dust removing performance of the sponge 23 is restored, and the durability can be improved.

Second Exemplary Embodiment

Next, a second exemplary embodiment of the present invention will be described. The second exemplary embodiment is the same as the first exemplary embodiment except that the configuration of the sponge and the frame portion is changed from the first exemplary embodiment. Therefore, illustration of the same elements as the first exemplary embodiment will be omitted or given by using the same reference signs.

Figure 5A:
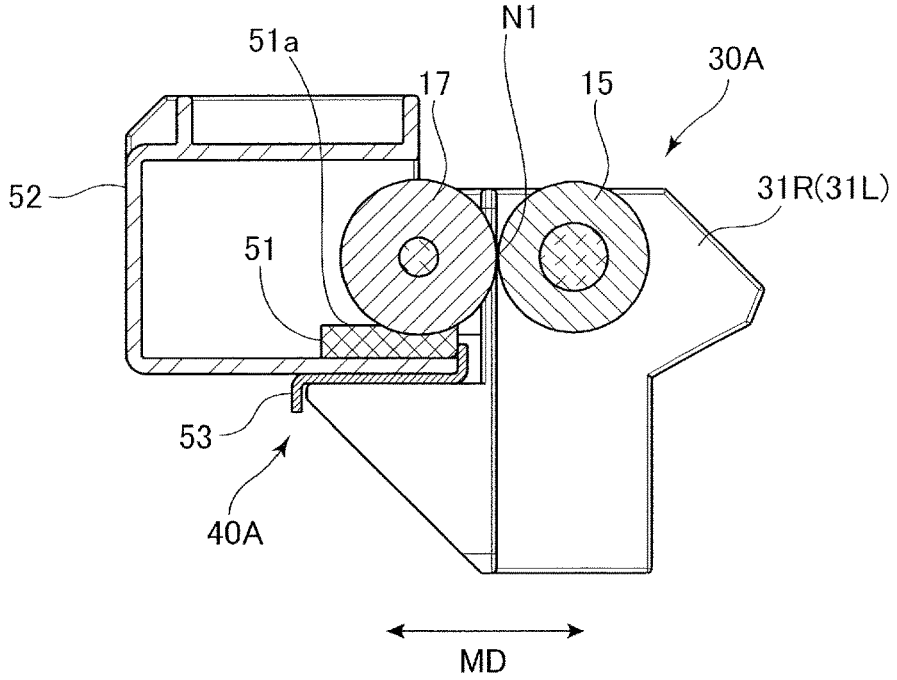
FIG. 5A is a section view of a sheet conveyance apparatus according to a second exemplary embodiment when a sheet is not passing through a conveyance nip.
Figure 5B:
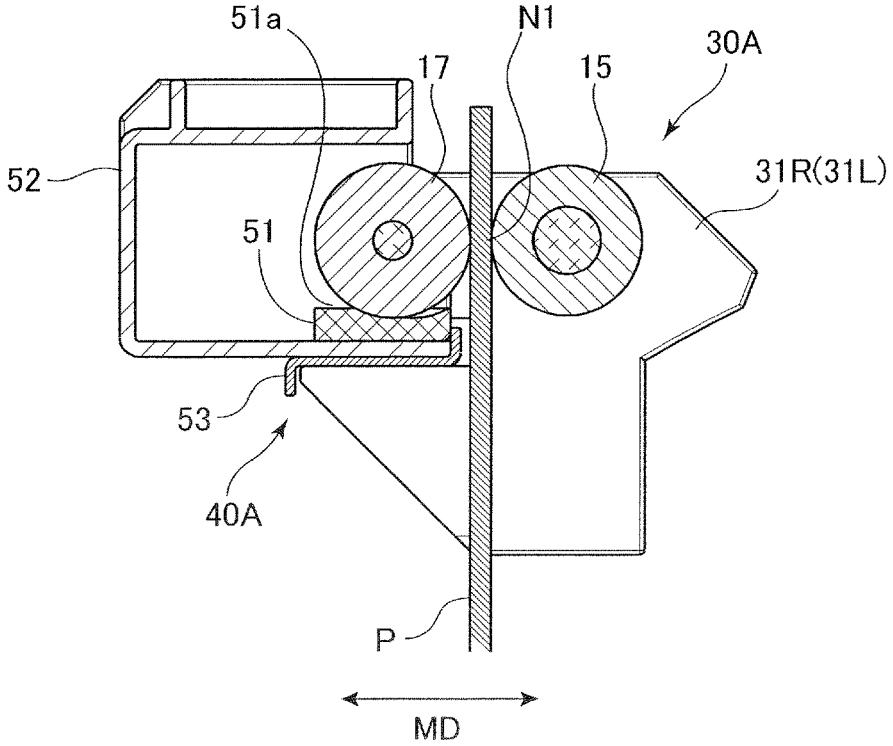
FIG. 5B is a section view of the sheet conveyance apparatus when a sheet is passing through the conveyance nip.

As illustrated in FIGS. 5A and 5B, a sheet conveyance apparatus 30A includes a frame portion 40A, the driving roller 15, the paper dust attracting roller 17, the pulling spring 24 illustrated in FIG. 2, and a sponge 51 serving as an abutting member. The frame portion 40A serving as a support portion includes the left frame 31L, the right frame 31R, a plate member 53, and a paper dust accommodating container 52. The plate member 53 is formed from, for example, a metal plate, and the paper dust accommodating container 52 is fixed to the plate member 53.

The sponge 51 is fixed to the paper dust accommodating container 52, and includes an opposing surface 51*a* serving as a second opposing surface extending in a direction parallel to the movement direction MD and opposing the paper dust attracting roller 17. The sponge 51 abuts the paper dust attracting roller 17 at different positions of the opposing surface 51*a* when the paper dust attracting roller 17 is positioned at the first position and when the paper dust attracting roller 17 is positioned at the second position. That is, the sponge 51 abuts the paper dust attracting roller 17 regardless of which of the first position and the second position the paper dust attracting roller 17 is positioned at.

Figure 6A:
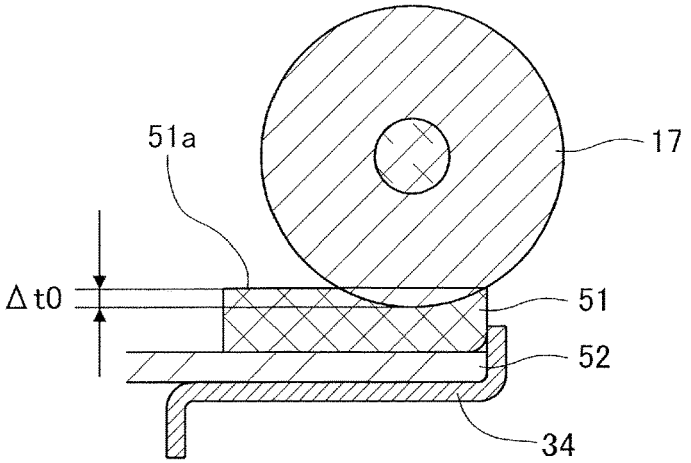
Figure 6B:
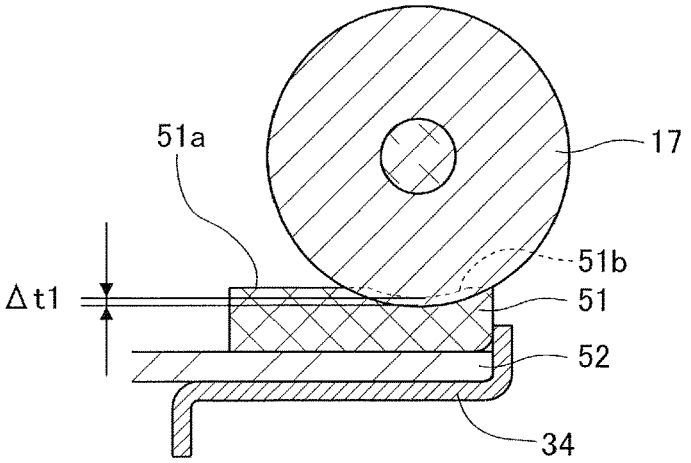
Figure 6C:
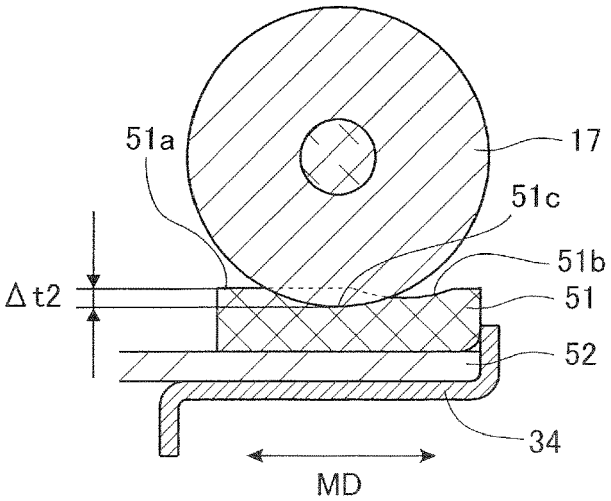

FIG. 6A is a section view of the paper dust attracting roller 17 and the sponge 51 before long-term storage when a sheet is not being passed through. FIG. 6B is a section view of the paper dust attracting roller 17 and the sponge 51 after long-term storage when a sheet is not being passed through. FIG. 6C is a section view of the paper dust attracting roller 17 and the sponge 51 after long-term storage when a sheet is being passed through. As illustrated in FIG. 6A, before long-term storage and when a sheet is not being passed through, the paper dust attracting roller 17 sinks in the sponge 51 by a third distance $\Delta t0$ from the opposing surface 51*a*.

Figure 7:
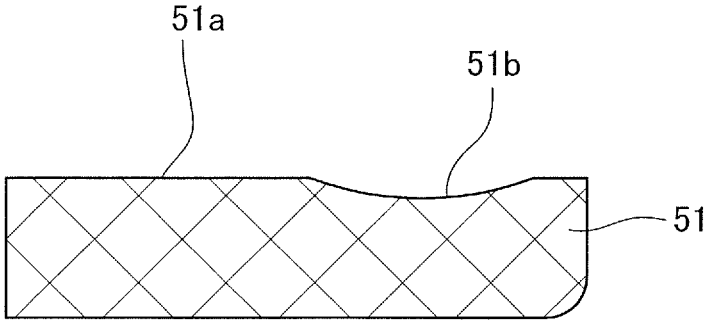
FIG. 7 is a side view of a sponge having undergone creep deformation.

In the case where the printer 100 is stored for a long period, as illustrated in FIG. 7, creep deformation of the sponge 51 occurs in accordance with the shape of the paper dust attracting roller 17 at a pressed portion 51*b* pressed by the paper dust attracting roller 17. In this case, as illustrated in FIG. 6B, when a sheet is not being passed through after long-term storage, the paper dust attracting roller 17 sinks in the sponge 51 by a fourth distance $\Delta t1$ from the pressed portion 51*b*. The distance $\Delta t1$ is smaller than the third distance $\Delta t0$ by an amount corresponding to the creep deformation of the sponge 51. That is, $\Delta t1<\Delta t0$ holds.

However, as illustrated in FIG. 6C, when the sheet P passes through the conveyance nip N1, the paper dust attracting roller 17 moves from the first position to the second position due to the thickness of the sheet P. As a result of this, the contact portion of the sponge 51 with the paper dust attracting roller 17 moves from the pressed portion 51*b* in the movement direction MD. In other words, the paper dust attracting roller 17 abuts the pressed portion 51*b* serving as a first region of the opposing surface 51*a* at the first position, and abuts a second pressed portion 51*c* serving as a second region of the opposing surface 51*a* different from the pressed portion 51*b* in the movement direction MD at the second position. Therefore, the paper dust attracting roller 17 abuts against a portion of the sponge 51 that has not undergone creep deformation, and thus sinks in the sponge 51 by a fifth distance $\Delta t2$ from the opposing surface 51*a*. In this case, the fifth distance $\Delta t2$ is equal to the third distance $\Delta t0$, that is, $\Delta t2=\Delta t0$ holds, and thus the contact pressure of the sponge 51 on the paper dust attracting roller 17 can be kept constant before and after long-term storage. That is, the paper dust attracting roller 17 sinks in the sponge 51 by the third distance $\Delta t0=\Delta t2$ from the opposing surface 51*a* in a direction perpendicular to the movement direction MD when the paper dust attracting roller 17 is positioned at the first position or the second position. Therefore, the paper dust removing performance of the sponge 51 does not change before and after long-term storage, and thus paper dust can be reliably removed to suppress image defects.

Figure 8:
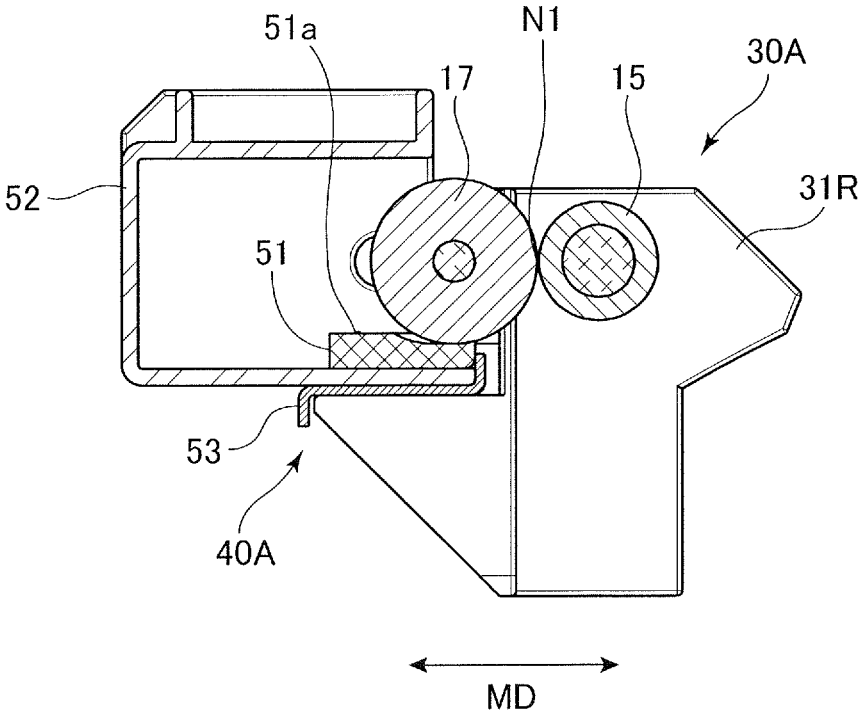
FIG. 8 is a section view of a sheet conveyance apparatus in a state in which a driving roller has worn.

Further, as illustrated in FIG. 8, when the driving roller 15 is worn from long use of the sheet conveyance apparatus 30A, the paper dust attracting roller 17 moves in a direction of approaching the driving roller 15. When the amount of wear of the driving roller 15 becomes larger than the thickness of the sheet P that passes through the conveyance nip N1, the paper dust attracting roller 17 abuts the sponge 51 at a position different from the pressed portion 51*b*. Therefore, the paper dust removing performance of the sponge 51 can be maintained not only after long-term storage but also in the case where the driving roller 15 is worn from long use, In addition, in the present exemplary embodiment, the sheet P is conveyed vertically upward, and the sponge 51 is disposed upstream of the conveyance nip N1 of the paper dust attracting roller 17 in the rotation direction, that is, at a position below the paper dust attracting roller 17. As a result of this, paper dust can be scraped off from the paper dust attracting roller 17 and stored in the paper dust accommodating container 52 without adding a new mechanism.

As described above, in the present exemplary embodiment, the sponge 51 abuts the paper dust attracting roller 17 by a constant contact pressure regardless of which of the first position and the second position the paper dust attracting roller 17 is positioned at. Therefore, the reliability of paper dust removal by the sponge 51 can be improved.

To be noted, in each embodiment that has been described, the member that forms the conveyance nip N1 with the paper dust attracting roller 17 is not limited to the driving roller 15, and may be a member that is not rotatable such as a separation pad. In this case, drive is input to the paper dust attracting roller 17 from an unillustrated drive source.

In addition, in each embodiment that has been described, a configuration in which the paper dust attracting roller 17 is pressed against the driving roller 15 by the elasticity of the sponge 23 or 51 without providing the pulling spring 24 may be employed.

In addition, in each embodiment that has been described, the driving roller 15 may also move in the movement direction MD when the sheet P passes through the conveyance nip N1 as long as the paper dust attracting roller 17 moves in the movement direction MD.

In addition, in each embodiment that has been described, the charging method of the paper dust attracting roller 17 is not limited to the rubbing of the sponge 23 or 51, and, for example, the amount of charge of the surface of the paper dust attracting roller 17 may be arbitrarily controlled by a charger or the like. In addition, the paper dust attached to the paper dust attracting roller 17 may be removed by using a resin sheet or the like instead of using the sponge 23 or 51.

In addition, although description has been given by using the printer 100 of an electrophotographic system in each embodiment that has been described, the present invention is not limited to this. For example, the present invention can be also applied to an image forming apparatus of an inkjet system that forms an image on a sheet by ejecting an ink liquid from a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-128623, filed Jul. 5, 2018, which is hereby incorporated by reference herein in its entirety.

What is claimed is:

1. A sheet conveyance apparatus comprising:

a conveyance portion comprising a rotary member and an opposing member and configured to convey a sheet in a conveyance nip, the opposing member being configured to oppose the rotary member to form the conveyance nip together with the rotary member;

an abutting member configured to abut a surface of the rotary member; and a support portion configured to rotatably support the rotary member, wherein the support portion supports the rotary member such that the rotary member is relatively movable between a first position and a second position with respect to the abutting member, wherein when the sheet is not passing through the conveyance nip, the rotary member is positioned at the first position where the rotary member abuts the opposing member, and when the sheet is passing through the conveyance nip, the rotary member is positioned at the second position which is more separated from the opposing member than the first position by a thickness of the sheet passing through the conveyance nip, wherein the abutting member abuts the rotary member regardless of which of the first position and the second position the rotary member is positioned at, and wherein the support portion supports the opposing member and the abutting member such that the opposing member and the abutting member do not move in a radial direction of the rotary member.

2. The sheet conveyance apparatus according to claim 1, further comprising:

an urging member configured to urge the rotary member toward the opposing member, wherein the rotary member moves from the first position to the second position against an urging force of the urging member when the sheet passes through the conveyance nip.

3. The sheet conveyance apparatus according to claim 1, wherein the abutting member is formed from an elastic member, and comprises a first opposing surface opposing the rotary member and extending in a direction intersecting a movement direction in which the rotary member moves between the first position and the second position.

4. The sheet conveyance apparatus according to claim 3, wherein the abutting member abuts the rotary member by a first contact pressure when the rotary member is positioned at the first position and by a second contact pressure larger than the first contact pressure when the rotary member is positioned at the second position.

5. The sheet conveyance apparatus according to claim 4, wherein the rotary member sinks in the abutting member by a first distance in the movement direction from the first opposing surface when the rotary member is positioned at the first position and by a second distance larger than the first distance in the movement direction from the first opposing surface when the rotary member is positioned at the second position.

6. The sheet conveyance apparatus according to claim 1, wherein the abutting member is formed from an elastic member and comprises a second opposing surface opposing the rotary member and extending in a direction parallel to a movement direction in which the rotary member moves between the first position and the second position.

7. The sheet conveyance apparatus according to claim 6, wherein the rotary member sinks in the abutting member by a third distance in a direction perpendicular to the movement direction from the second opposing surface when the rotary member is positioned at the first position and when the rotary member is positioned at the second position.

8. The sheet conveyance apparatus according to claim 6, wherein the rotary member abuts a first region of the second opposing surface at the first position, and abuts a second region of the second opposing surface different from the first position in the movement direction at the second position.

9. The sheet conveyance apparatus according to claim 1, wherein the abutting member abuts the surface of the rotary member to scrape off paper dust attached to the surface.

10. The sheet conveyance apparatus according to claim 1, wherein the opposing member is a driving roller, and wherein the rotary member is a roller that is rotated in accordance with the driving roller.

11. An image forming apparatus comprising:

the sheet conveyance apparatus according to claim 1; and an image forming portion configured to form an image on a sheet.

12. A sheet conveyance apparatus comprising:

a conveyance portion comprising a rotary member and an opposing member and configured to convey a sheet in a conveyance nip, the opposing member being configured to oppose the rotary member to form the conveyance nip together with the rotary member;

an abutting member configured to abut a surface of the rotary member, the abutting member being formed from an elastic member; and a support portion configured to rotatably support the rotary member, wherein the support portion supports the rotary member such that the rotary member is relatively movable between a first position and a second position with respect to the abutting member, wherein when the sheet is not passing through the conveyance nip, the rotary member is positioned at the first position where the rotary member abuts the opposing member, and when the sheet is passing through the conveyance nip, the rotary member is positioned at the second position which is more separated from the opposing member in a thickness direction of the sheet than the first position by a thickness of the sheet passing through the conveyance nip, wherein the abutting member includes an opposing surface opposing the rotary member and extending in a direction parallel to a movement direction in which the rotary member moves between the first position and the second position, wherein in a case where the rotary member moves from the first position to the second position, a part of an abutting area, abutting the rotary member positioned in the first position, of the opposing surface is separated from the rotary member, and another area of the opposing surface abuts the rotary member, and wherein the support portion supports the opposing member and the abutting member such that the opposing member and the abutting member do not move in a radial direction of the rotary member.

13. The sheet conveyance apparatus according to claim 12, wherein the opposing surface of the abutting member abuts the rotary member regardless of which of the first position and the second position the rotary member is positioned at.

14. The sheet conveyance apparatus according to claim 12, further comprising an urging member configured to urge the rotary member toward the opposing member, wherein the rotary member moves from the first position to the second position against an urging force of the urging member when the sheet passes through the conveyance nip.

15. The sheet conveyance apparatus according to claim 12, wherein the rotary member sinks in the abutting member by a predetermined distance in a direction perpendicular to the movement direction from the opposing surface when the rotary member is positioned at the first position and when the rotary member is positioned at the second position.

16. The sheet conveyance apparatus according to claim 12, wherein the opposing member is a driving roller, and wherein the rotary member is a roller that is rotated in accordance with the driving roller.

17. An image forming apparatus comprising:

the sheet conveyance apparatus according to claim 12; and an image forming portion configured to form an image on a sheet.

* * * * *